United States Patent [19]

Barclay et al.

[11] Patent Number: 4,594,588

[45] Date of Patent: Jun. 10, 1986

[54] PLASMA DISPLAY MARGIN CONTROL

[75] Inventors: Terry W. Barclay; John R. Cielo, both of Kingston, N.Y.; William J. Martin, San Jose, Calif.; James B. Trushell, Saugerties, N.Y.

[73] Assignee: International Business Machines Corporation, Armonk, N.Y.

[21] Appl. No.: 472,778

[22] Filed: Mar. 7, 1983

[30] Foreign Application Priority Data

Sep. 2, 1983 [JP] Japan ..... 58-161724

[51] Int. Cl.[4] ..... G09G 3/22

[52] U.S. Cl. ..... 340/771; 340/805

[58] Field of Search ..... 340/771, 776, 778, 805

[56] References Cited

U.S. PATENT DOCUMENTS

| | | | |
|---|---|---|---|
| 3,903,512 | 9/1975 | Mauro, Jr. | 340/771 |
| 3,962,700 | 6/1976 | Criscimagna et al. | 340/771 X |
| 3,973,253 | 8/1976 | Criscimagna et al. | 340/771 |
| 3,993,990 | 11/1976 | Miller et al. | 340/776 |
| 4,017,762 | 4/1977 | Criscimagna et al. | 340/776 X |
| 4,030,091 | 6/1977 | Ngo | 340/771 |
| 4,079,290 | 3/1978 | Trushell | 340/776 X |
| 4,109,180 | 8/1978 | Ogle et al. | 340/771 |
| 4,320,418 | 3/1982 | Pavliscak | 340/771 X |

*Primary Examiner*—Marshall M. Curtis

*Assistant Examiner*—Vincent P. Kovalick

*Attorney, Agent, or Firm*—Joseph J. Connerton

[57] ABSTRACT

In large size high resolution plasma panels, a smaller discharge gap between the electrodes reduces the operating margin of the panel, i.e., the difference between the maximum and minimum sustain voltage ($V_s$max and $V_s$min). Rather than preset these values which vary with each panel at the time of fabrication, the invention provides a control system for determining the $V_s$max and $V_s$min and the optimum operating point between these values for each panel. An associated microprocessor determines the $V_s$min for each panel through a testing algorithm, and the $V_s$max is provided by either adding a predetermined increment to the $V_s$min or by a testing sequence. The operating point is designated as a predetermined increment below $V_s$max. The invention operates each time the panel is turned on, thereby compensating for voltage drift or other panel parameter variations. By using a high speed microprocessor, the entire sequence is accomplished in a short time, while exercising the cells through the test sequence eliminates some of the "start-up" problems sometimes associated with such displays.

7 Claims, 4 Drawing Figures

PLASMA DISPLAY MARGIN CONTROL

CROSS REFERENCE TO RELATED PATENT APPLICATIONS

U.S. application Ser. No. 372,384, "Improved Method and Apparatus for Gas Display Panel," filed by Tony N. Criscimagna et al. June 21, 1973.

U.S. application Ser. No. 680,755, "Gas Panel Voltage Regulator," filed by James B. Trushell, May 29, 1976, now U.S. Pat. No. 4,079,290.

BACKGROUND OF THE INVENTION

In plasma display devices, conductor arrays disposed on glass plates are overcoated with a dielectric layer, and the glass plates sealed with the conductor arrays disposed orthogonal to each other, the conductor intersections defining display cells. By selectively applying appropriate signals to the conductor arrays, the display cells are discharged to provide a visible display, while forming a wall charge on the cell walls. The display is maintained by a lower amplitude sustain signal which combines with the wall charge potential formed at the selected intersections.

Fabrication techniques for plasma display devices are well known in the art, and are shown, for example, in U.S. Pat. No. 3,837,724, filed by Peter H. Haberland et al. Oct. 10, 1973. Another patent directed to gas panel fabrication is U.S. Pat. No. 3,804,609, filed by Thomas J. Murphy et al. on Dec. 30, 1971.

Such devices heretofore were of relatively small size and low resolution and possessed high operating margins, i.e., the difference between the maximum and minimum sustain voltages ($V_s$ max$-V_s$ min). The operating or reference point for the sustain voltage is some point between the maximum and minimum sustain voltage.

Due to the relatively large operating margin of such devices, sometimes designated the window, the adjustments for write, erase and sustain voltages of these panels could be preset at the manufacturing facility. End of life condition occurred when the sustain voltages either drifted or the voltage margin otherwise moved outside the specified tolerances. However, panels of larger size and higher resolution required a smaller discharge gap, i.e., the distance between the inner surfaces of the two plates, producing a decrease in voltage margin. With a low voltage margin, it becomes increasingly difficult to maintain the required uniformity for preselected adjustments since the operational characteristics of plasma display panels vary on a panel by panel basis.

SUMMARY OF THE INVENTION

The subject invention is directed to a system which operates on the premise that every time the plasma display is turned on or "powered up", a test pattern controlled by a digital control circuit such as a microprocessor is generated to identify the maximum and minimum sustain voltages and the optimum operating point for the individual panel. The plasma display operation as well as the control logic used to control these operations, may correspond to that described in the aforereferenced application Ser. No. 372,384. As described in more detail hereinafter, after the unit has been "powered up" and all circuits are operational, the minimum ($V_s$ min) sustain voltage is initially determined. Due to the heavy current conditions in large size panels, the panel may be logically divided, into quadrants or thirds, for example, during the test pattern interval for determining maximum and minimum sustain voltages, although each individual cell in the panel is tested. For the purpose of this invention, the term $V_s$max defines the sustain voltage at which unselected cells turn on or where cells cannot be selectively erased, while $V_s$min defines the lowest sustain voltage level at which all selected cells remain on. The worst case or highest $V_s$ min obtained by the microprocessor during the test pattern is selected as the basis for subsequent operations. The ($V_s$ max) sustain is next determined by another sustain voltage ranging algorithm. The operating point of the panel is then set at a specified point relative to the $V_s$ min and $V_s$ max values. By operating in this matter, relatively low cost components with large tolerances can be utilized, while the invention provides the additional advantage that at least once for each power on cycle, every cell on the panel is exercised, tending to eliminate some of the start-up problems associated with plasma panels. The invention utilizes an analog section and a digital section. The analog section controls the sustain voltage, controls the vertical sustainer gate voltage and detects vertical sustain current. Implementation of the analog section includes sample and hold gates, an integrator, a comparator and a digital to analog converter. The digital section controls pattern generation and sequencing, analog control sequencing, and analog to digital conversion and analysis.

Accordingly, a primary object of the present invention is to provide an improved automatic adjustment for the sustain signal operating point in a plasma display device.

Another object of the present invention is to provide an improved method of determining the appropriate maximum and minimum sustain voltages for a large size high resolution plasma display device and selecting the operating point between these values for maximum efficiently.

Still another object of the present invention is to provide a simplified automatic adjust system for a plasma display panel wherein the operating parameters of the device are preset, with each panel operation thereby providing a substantial increase in panel operating life.

DESCRIPTION OF A PREFERRED EMBODIMENT

Figure 1A:
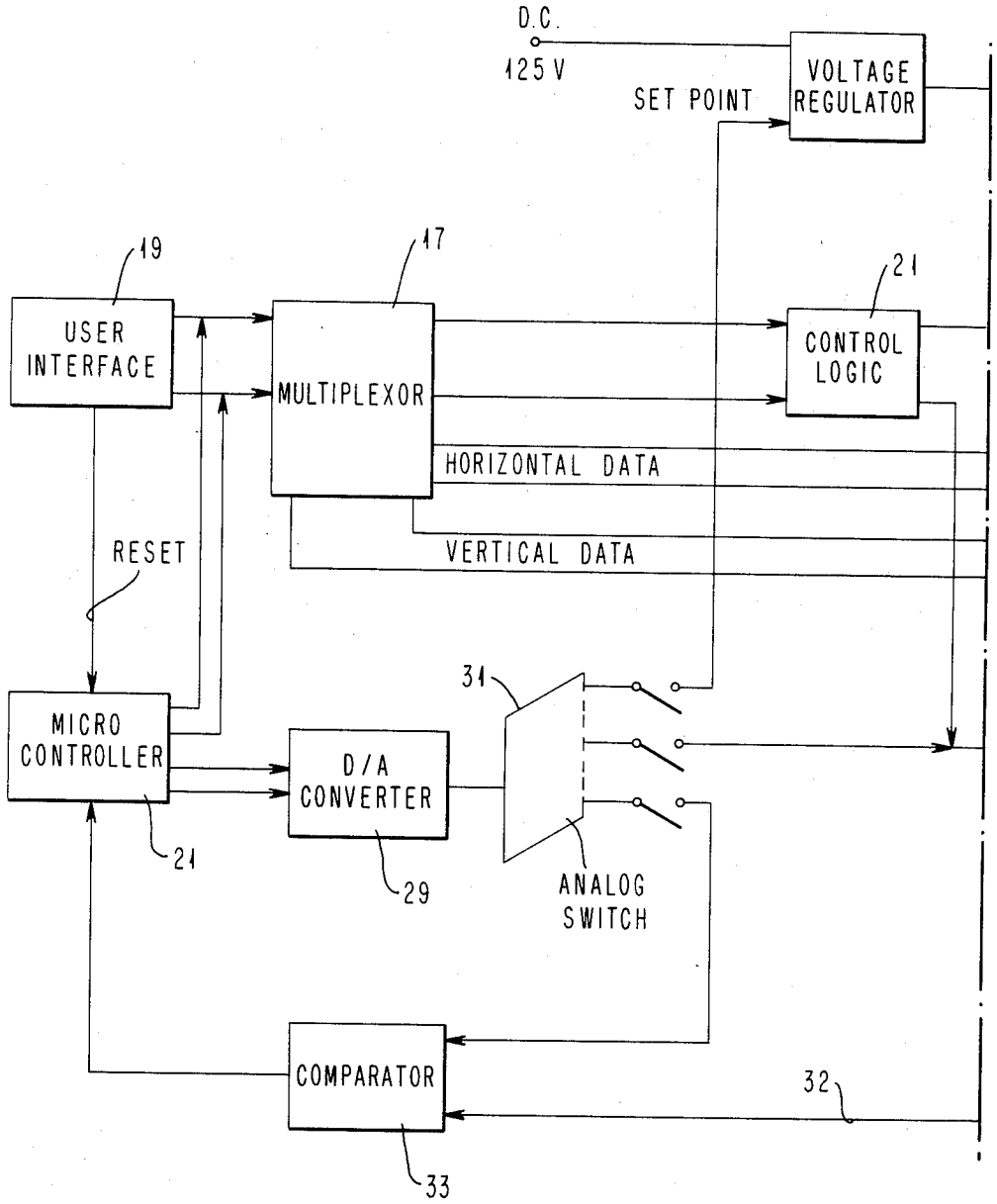
FIGS. 1A and 1B illustrate in block schematic form a preferred embodiment of the instant invention.
Figure 1B:
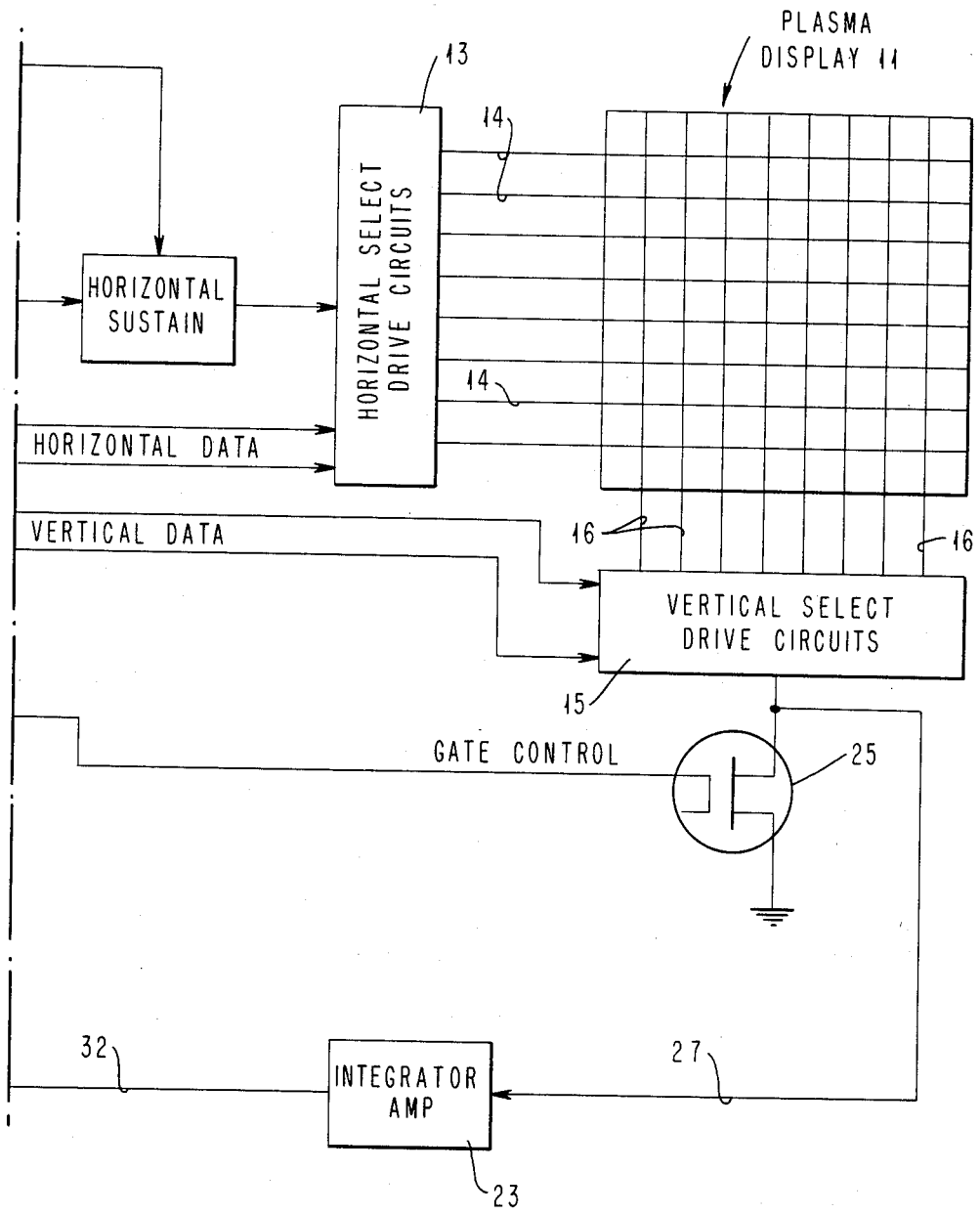

Referring now to the drawing and more particularly to FIGS. 1A and 1B thereof, there is illustrated a display system comprising plasma display panel 11 having horizontal and vertical select and drive circuits 13, 15 which apply data received from a multiplexer 17 to the horizontal and vertical drive lines 14 and 16 respectively. The select and drive circuits 13, 15 may correspond to those disclosed in the referenced application Ser. No. 372,384, while display panel 11 may correspond technologically to that shown in the referenced U.S. Pat. No. 3,837,724 except that larger size higher resolution panels having smaller discharge gaps are contemplated.

In the preferred embodiment of the invention, a user interface 19 and microcontroller 21 are interconnected to the plasma display 11 through multiplexer 17, the user interface comprising, for example, a display controller, while microcontroller 21 comprises, in the preferred embodiment of the invention, an Intel Model 8048 microprocessor. Display data, which may originate in a data processor, telephone line or other logic device, is generally provided through user interface 19, while, as more fully described hereinafter, the microcontroller 21 provides the pattern generation and sequencing used to determine the operating point of the sustain signal.

Before proceeding with the description of the instant invention, reference is made to the operation of plasma display panels for necessary data relating to their unique requirements. As noted in the background of the invention, display cells are defined by the intersections of horizontal and vertical conductors, which, when energized by appropriate drive signal, discharge the gas at the intersection to emit light. A plurality of such discharge cells can form any display, alphanumeric or graphic. When a cell is discharged, a wall charge potential is formed at the selected intersection which combines with a lower amplitude signal designated the sustain potential to redischarge the cell. By applying a sequence of sustain signals at approximately a 40 kilocycle rate, a flicker free display is provided. Selective erase is provided by essentially neutralizing the wall charge of selected cells.

Examples of plasma panel write operations are disclosed in the IBM Technical Disclosure Bulletin, Vol. 21, No. 3, August 1978, pages 1101, 1102, while the erase operation is described in the IBM Technical Disclosure Bulletin, Vol. 21, No. 2, July 1978, page 683. The above identified TDB articles are incorporated herein by reference. Note in the first identified reference the problem of excessive wall voltages during write and excess of peak avalanche current at a succeeding sustain transition following write, problems which will be addressed in greater detail hereinafter.

While the general operating parameters of a plasma display device are known, the development of an automatic adjust system requires the generation of patterns and sequences which will test for actual operating conditions, albeit generally worst case conditions, of minimum and maximum sustain voltages ($V_s$min and $V_s$max) for each individual panel. For the $V_s$min case, a pattern of all ones is generated by the microcontroller 21, i.e., all cells are turned on, a pattern which permits fast and efficient data acquisition, as well as providing the worst case write timings and maximum current loadings. The excess peak avalanche current problem is handled by manipulating only a portion of the panel at any given time, one third of the panel in the preferred embodiment, although each individual cell must be addressed.

To determine the $V_s$min voltage, i.e., the minimum sustain voltage at which selected cells remain on, the voltage pattern of all ones described above may be repeatedly written as the sustain voltage is stepped. The system must be set to measure the vertical current via integrator amplifier 23 and convert this to a digital signal through comparator 33 which can then be identified by the system. A technique to sense the panel current was developed with feedback to form a closed loop system. The digital signal is thus proportional to the panel current.

The requirements of such a panel current detection system was that it have no adverse effects on voltage or current paths, that it provide a fast response and that it be proportional to the load. In the preferred embodiment of the invention, integrator amplifier 23 integrates the current in the vertical sustain path which contains only avalanche or discharge and displacement currents. By integrating only during avalanche time, most of the displacement current is eliminated, thus yielding an acceptable signal to noise ratio. The gain in the vertical current path is controlled by varying the bias on the vertical sustain FET 25. A similar FET configuration would be required in a plasma panel driven from opposite sides on alternate lines thereof. The vertical current on line 27 is proportional to the number of cells lit and hence the minimum sustain voltage, thus yielding a dual slope current vs voltage plot as shown in FIG. 3.

Figure 3:
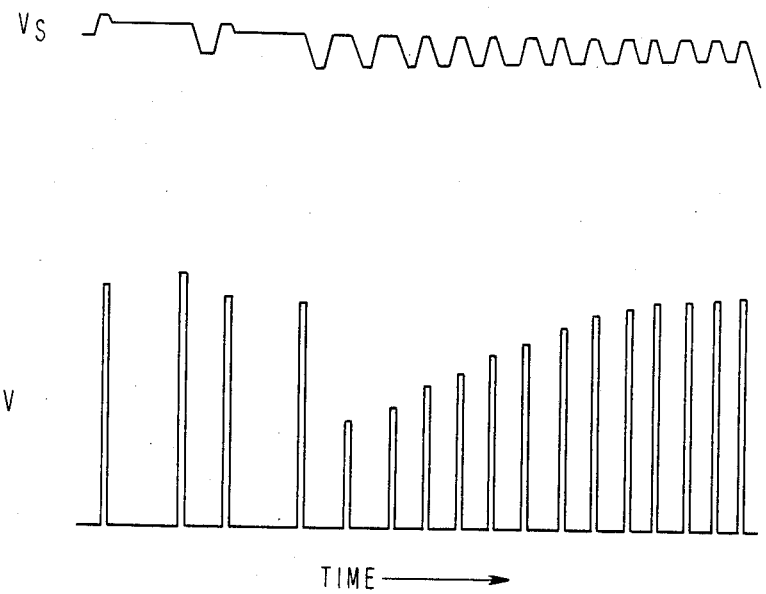
FIG. 3 is a timing diagram of the base sustain voltage technique.

Referring briefly to FIG. 3, a technique called base sustain voltage was developed to increase speed and improve the detection of the knee shown in FIG. 3. The upper trace in FIG. 3 indicates the sustain voltage applied to the horizontal sustainers, while the lower trace indicates the voltage on line 32 back to comparator 33. This technique establishes a base voltage, a level somewhat above the minimum sustain voltage. All vertical current measurements, after having been established by erasing and writing the panel at voltage levels below the base voltage, must be taken at the base voltage. By employing a constant base voltage, the voltage factor in the current vs voltage plot is eliminated, while the minimum sustain detection is improved. The impedence of the vertical FET 25 while measuring current is immaterial because the voltage drop across the FET 25 is less than the difference between the base voltage and the minimum sustain voltage.

Figure 2:
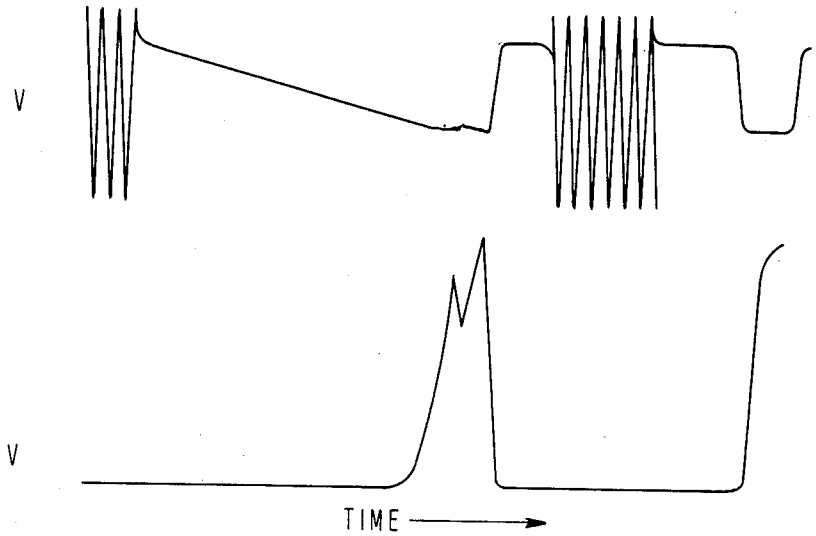
FIG. 2 is a timing diagram of the vertical gate biasing routine.

The vertical gate biasing routine is used to find a bias point for the vertical sustain FETs 25, which have a large gain/resistance variation, such that the vertical current detect circuits are operating within their range. This is accomplished by first setting the sustain voltage to a base value and writing a reference pattern on the display (See FIG. 2). The next step is to ramp the bias of the vertical sustain FET gate 25 while checking the vertical current detection circuitry output on line 27. When the vertical current detection circuitry output is within the proper operating range, the vertical FET bias point is stored. This bias point is then used for all further vertical current measurements taken at that base voltage.

When the base sustain voltage is changed because of program flow, a new vertical FET bias point is required. The minimum sustain voltage ranging algorithm finds the approximate minimum sustain voltage. Utilizing the base voltage technique previously described, vertical sustain currents are measured at large sustain voltage increments (see FIG. 2). The values of these currents are then analyzed to determine the approximate minimum sustain voltage.

The minimum sustain voltage algorithm uses the information gathered by the minimum sustain voltage ranging routine to determine its starting sustain voltage. It then proceeds to use the base voltage technique as before, but this time the vertical current measurements are taken at fine sustain voltage increments. The values of these current measurements are analyzed to determine the minimum sustain voltage. The actual sustain values are generated by microprocessor 21 and applied through D/A converter 29 and analog switch 31 to comparator 33, where it is compared with the analog output from integrator amplifier 23. In the preferred embodiment of the invention, the microprocessor 21 utilizes only a simple algorithm to perform these functions, an algorithm which is well known to those skilled in the art and is accordingly omitted in the interest of clarity.

Establishing the $V_s$max sustain voltage requires writing a checkerboard (alternate cell) pattern of minimal load and then selectively erasing the same checkerboard pattern. Failures to erase, or extra lighted cells, are errors. Checking for cells left on after the entire panel has been written and erased, usually 50 passes, saves time and makes cumulative errors easier to detect. Such a test is speed dependent, and results change with the length of time the cells are left on before they are erased. To compensate for this dependence, a speed/-offset compromise was made.

Searching for the maximum sustain voltage, even using a microprocessor, would be time consuming, and since operation near the minimum sustain voltage is advantageous, a single pass for normal margin is made. In the preferred embodiment of the invention, the normal margin is 4.35 volts, which may be added to $V_s$min. If verified, further testing is not required. In the case where the $V_s$max is exceeded, further testing at reduced sustain voltage must be undertaken to determine the actual $V_s$max. Once the normal sustain voltage margin is verified, or the maximum sustain voltage is determined, the microcontroller then calculates the optimum operational voltage.

By means of the present invention, the optimum operating point of each plasma panel is determined each time the panel is turned on. The control and measurement sequences provided by the microprocessor with respect to the subject invention are deemed elementary in the data processing art and the details have accordingly been omitted for avoid prolix in the instant application. The sustain voltage can be incremental in 0.2 volt increments. The normal variations in panel parameters or operating conditions such as temperature, atmospheric pressure, age, etc. are automatically compensated for, and a high resolution display is provided.

We claim:

1. A control system for automatically determining the operating sustain voltage margin and optimum operating point of the sustain signal within said margin for a plasma display device, said operating sustain voltage margin comprising the difference between a maximum and minimum sustain signal amplitude comprising, in combination, a high resolution plasma display device comprising orthogonally disposed conductor arrays having drive and control circuitry associated with the horizontal and vertical axes of said device, the intersections of said conductor arrays defining plasma display cells, means for generating and applying a test pattern of write and sustain signal sequences to the conductors of at least one of said arrays of said plasma display device whereby a plurality of cells in said plasma display are selectively discharged and sustained, means for applying signals generated by a sustain signal-ranging algorithm to one of said conductor arrays and measuring the resulting discharge current from the conductors of said other array of said plasma display device, and means for comparing said discharge current resulting from said test pattern to the signals generated by said sustain signal ranging algorithm to establish a minimum operating point, said discharge current corresponding in magnitude to the number of cells discharged.

2. A control system of the type claimed in claim 1 wherein said means for generating and applying said test pattern of write and sustain signal sequences and said means for generating said sustain signal ranging algorithm is a microprocessor.

3. A control system of the type claimed in claim 1 wherein said discharge current is converted to a voltage signal prior to said comparison with said sustain signal ranging algorithm.

4. A control system of the type claimed in claim 3 wherein said test pattern signal sequence is converted to analog form prior to said comparison with said discharge current representative signals.

5. A control system of the type claimed in claim 1 wherein a predetermined voltage increment is added to said minimum sustain signal level to generate the maximum sustain voltage.

6. A control system of the type claimed in claim 1 wherein a second sustain signal ranging algorithm is used to identify the maximum sustain signal level.

7. A control system of the type claimed in claim 5 wherein said operating point is calculated at a predetermined increment below said maximum sustain signal.

* * * * *